United States Patent [19]

Yamada et al.

[11] Patent Number: 5,028,042

[45] Date of Patent: Jul. 2, 1991

[54] IMAGE FORMING APPARATUS HAVING A CONTROLLER TO PREVENT ERRONEOUS FEEDING FROM A ROTATABLE CASSETTE AND METHOD THEREOF

[75] Inventors: Yoshikado Yamada, Kashihara; Yoshiteru Mori, Nara; Yoshiyuki Noda, Kyoto, all of Japan

[73] Assignee: Sharp Kabushiki Kaisha, Osaka, Japan

[21] Appl. No.: 515,616

[22] Filed: Apr. 27, 1990

[30] Foreign Application Priority Data

May 15, 1989 [JP] Japan ..... 1-121808

[51] Int. Cl.[5] ..... B65H 3/44

[52] U.S. Cl. ..... 271/9; 271/227; 271/241; 271/254; 271/265

[58] Field of Search ..... 271/9, 127, 157, 162, 271/164, 171, 145, 227, 241, 253-255, 265

[56] References Cited

U.S. PATENT DOCUMENTS

| | | | |
|---|---|---|---|
| 4,540,170 | 9/1918 | Masuda et al. | 271/265 X |
| 4,809,050 | 2/1989 | Ito . | |
| 4,874,958 | 10/1989 | Sampath et al. | 271/265 X |

FOREIGN PATENT DOCUMENTS

| | | | |
|---|---|---|---|
| 56-59245 | 5/1981 | Japan . | |
| 37945 | 9/1981 | Japan | 271/265 |
| 59-123859 | 7/1984 | Japan . | |
| 27251 | 2/1987 | Japan | 271/9 |
| 74850 | 4/1987 | Japan | 271/265 |
| 2128367 | 4/1984 | United Kingdom . | |

*Primary Examiner*—Robert P. Olszewski
*Assistant Examiner*—Boris Milef

[57] ABSTRACT

An image forming apparatus comprising: a rotating section of a rotatable cassette movable between a longitudinal feed position from which paper longitudinally oriented with respect to a feeding direction is fed and a lateral feed position from which paper laterally oriented with respect to the feeding direction is fed; a document size detection device for detecting the size and orientation of a document; an automatic paper selection function for selecting a cassette in accordance with document size/orientation data obtained from the document size detection device and magnification data; a timer for measuring a predetermined perod of time; a RAM for storing the document size/orientation data; and control a device for (i) controlling the timer to start its measuring operation upon detection of a document size/orientation by the document size detection device, (ii) controlling the movement of the rotating section of the rotatable cassette to a position which corresponds to a determined orientation of the copy paper if the rotatable cassette is selected by the automatic paper selection function, and there occurs no change in the document size/orientation data sent from the document size detection device to the RAM before the completion of the measuring operation by the timer, and renewing the document size/orientation data stored in the RAM and restarting the measuring operation of the timer if the document size/orientation data have been changed before the completion of the first set measuring operation of the timer. With the above arrangement, even if there occurs a change in the document size/orientation data due to a detection error etc. within a predetermined time period, the rotating section of the rotatable cassette can be set in a desired feed position without undesirable rotations.

19 Claims, 8 Drawing Sheets

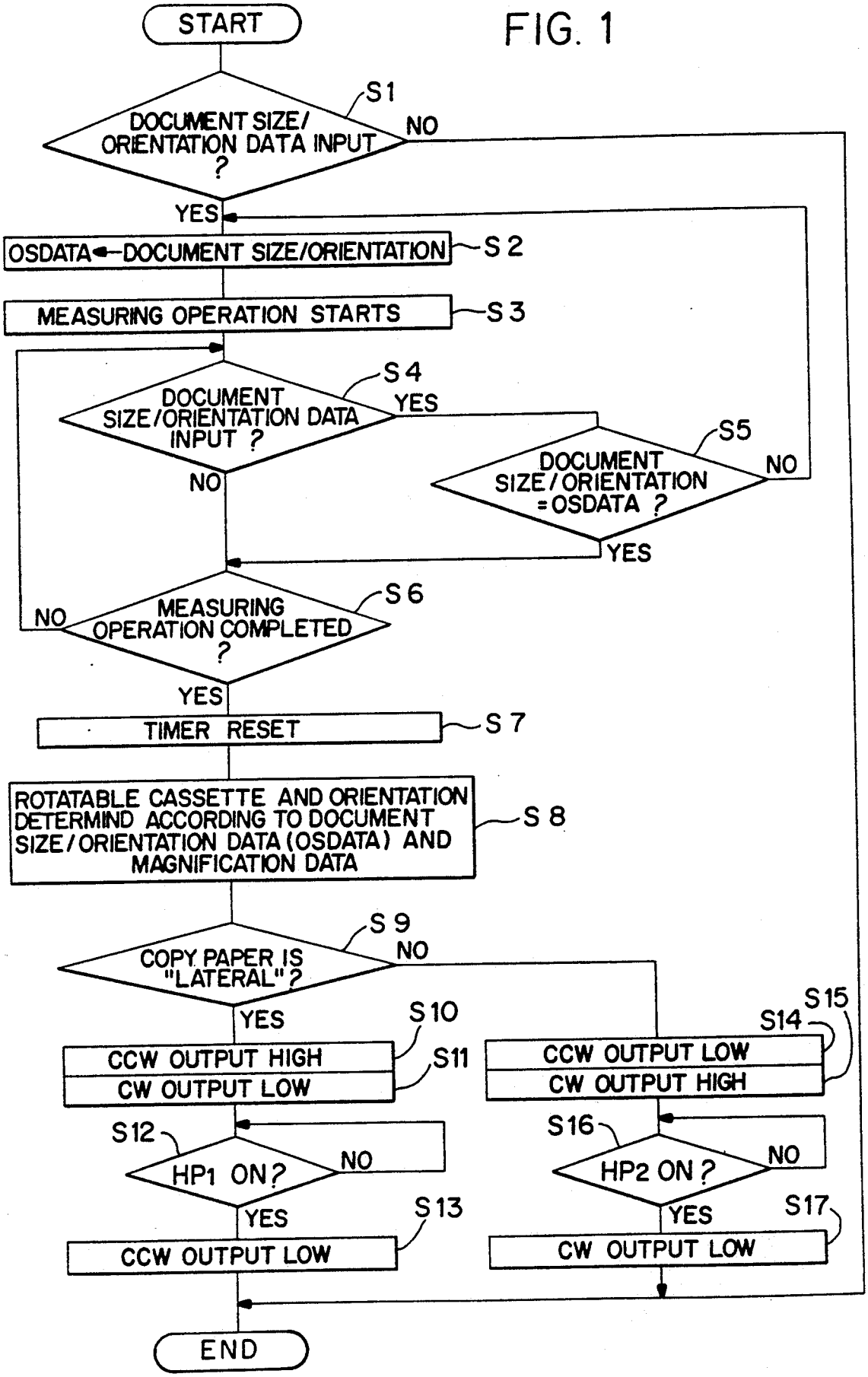
FIG. 1
START
S1
DOCUMENT SIZE/ ORIENTATION DATA INPUT ?
NO
YES
OSDATA←DOCUMENT SIZE/ORIENTATION
S2
MEASURING OPERATION STARTS
S3
S4
DOCUMENT SIZE/ORIENTATION DATA INPUT ?
YES
NO
S5
DOCUMENT SIZE/ORIENTATION =OSDATA ?
NO
YES
S6
MEASURING OPERATION COMPLETED ?
NO
YES
TIMER RESET
S7
ROTATABLE CASSETTE AND ORIENTATION DETERMIND ACCORDING TO DOCUMENT SIZE/ORIENTATION DATA (OSDATA) AND MAGNIFICATION DATA
S8
S9
COPY PAPER IS "LATERAL"?
NO
YES
S10
CCW OUTPUT HIGH
S11
CW OUTPUT LOW
S12
HP1 ON?
NO
YES
S13
CCW OUTPUT LOW
S14
S15
CCW OUTPUT LOW
CW OUTPUT HIGH
S16
HP2 ON ?
NO
YES
S17
CW OUTPUT LOW
END

IMAGE FORMING APPARATUS HAVING A CONTROLLER TO PREVENT ERRONEOUS FEEDING FROM A ROTATABLE CASSETTE AND METHOD THEREOF

FIELD OF THE INVENTION

The present invention relates to image forming apparatus such as copying machines and printers that are provided with rotatable cassettes for feeding copy materials.

BACKGROUND OF THE INVENTION

Conventional copying machines serving as an image forming apparatus are generally provided with a plurality of paper feed cassettes, i.e., a cassette for each paper size. It is preferable in view of the feeding speed to feed copy paper laterally oriented with respect to a feed direction (this way of paper feeding is hereinafter referred to as "lateral feed") rather than to feed copy paper longitudinally oriented with respect to the feed direction (this way of paper feeding is hereinafter referred to as "longitudinal feed"). In fact, not only small size copy papers but large size copy papers such as B4-size copy paper and A3-size copy paper are laterally fed in some copying machines.

However, in order to accept large size copy paper laterally fed, the sizes of the photosensitive drum, delivery roller and paper feed path within the main body of the copying machine have to be increased, resulting in a bulky and costly copying machine. Therefore, copying machines are generally arranged such that large size papers such as B4-size paper and A3-size paper are longitudinally fed while small size papers such as A4-size paper are laterally fed.

Such an arrangement is not suitable for a copying machine having a variable magnification function for image enlargement and reduction, because a B5R cassette for feeding B5-size paper longitudinally oriented and a A4R cassette for feeding A4-size paper longitudinally oriented are needed in order to perform reduction copying operation while a B5 cassette and a A4 cassette for lateral feed are needed in consideration of the feeding speed. There arise still some problems in providing a variety of paper cassettes in a copying machine: that is, the size of the copying machine have to be increased; or a plurality of paper cassettes have to be changed according to purposes when copying. As a result, the apparatus becomes bulky and costly; the operation will otherwise be more troublesome.

A number of approaches to solve the foregoing problems have been provided. One solution is disclosed in Japanese Patent Publication (laid-open) No. 59245/1981 (Tokukaisho 56-59245) and Japanese Patent Publication (laid-open) No. 123859/1984 (Tokukaisho 59-123859): in those inventions, a B5 cassette is also used as a B5R cassette and a A4 cassette as a A4R cassette, that is, one cassette is used both for lateral feed and longitudinal feed by changing the orientation of copy paper stored in the cassette.

In Japanese Patent Publication 59245/1981, whenever a magnification mode is switched from real size copying to reduction/enlargement copying or vice versa, the rotating section of a specified rotatble cassette, the rotating section on which copy paper is stacked, is turned to a longitudinal feed position or lateral feed position.

In the case the above arrangement (i.e., the rotating section of a specified rotatable cassette is rotated whenever a magnification mode is changed) is applied to a copying machine having an automatic paper selection function in which a cassette storing paper to be used is automatically selected according to a document size/orientation and a specified magnification rate, if an error occurs in detection of the document size/orientation, the rotating section of a specified rotatable cassette is rotated every time when the data of the document size/orientation are changed. In such a case, the rotating section is forced into undesirable rotations, and consequently, the office environment is considerably disturbed by noise caused by the rotations of the rotating section.

SUMMARY OF THE INVENTION

One of the objects of the present invention is to provide an image forming apparatus provided with at least one copy material orientation changing means which can be set in a desired feed position without being uselessly moved even if the data of a document size/orientation are changed due to a detection error etc. during a time preset by the timer.

Another object of the present invention is to provide an image forming apparatus with which noise caused when the copy material orientation changing means is driven by the driving mechanism, is reduced in order to preserve the office environment.

In order to achieve the above objects, the image forming apparatus of the invention comprises at least one copy material orientation changing means for setting copy material in at least two feed positions and document size detection means for detecting the size/orientation of a document, the copy material orientation changing means being driven by driving means. The image forming apparatus is provided with an automatic copy material selection function by which a fixed copy material feed unit or a movable copy material feed unit that stores appropriate copy material to be fed is selected for use, based on document size/orientation data obtained from the document size detection means and the data of a set magnification rate, and forms an image on a copy material with the set magnification rate. The image forming apparatus further comprises a timer for measuring a predetermined time period; memory means for storing the data of a document size/orientation; and control means for (i) starting the measuring operation of the timer upon detection of the size/orientation of a document by the document size detection means, (ii) controlling the driving means to set copy material orientation changing means disposed in the movable copy material feed unit, in a feed position corresponding to a determined orientation of copy material, when the movable copy material feed unit is selected for feeding copy material by the automatic copy material selection function, and the document size/orientation data sent from the document size detection means to the memory means have not been changed before the measuring operation by the timer is completed, (iii) renewing the document size/orientation data stored in the memory means and starting the measuring operation of the timer again when the document size/orientation data sent from the document size detection means have been changed before the first measuring operation is completed.

In such an arrangement, the control means controls the timer to start its measuring operation when the document size detection means detects a document size/orientation. When the movable copy material feed unit is selected for feeding copy material by the automatic copy material selection function and the document size/orientation data sent from the document size detection means to the memory means have not been changed before the measuring operation by the timer is completed, the control means controls the driving means to set the copy material orientation changing means of the movable copy material feed unit in a feed position corresponding to a determined orientation of the copy material. On the other hand, when the document size/orientation data sent from the document size detection means have been changed before the measuring operation is completed, the control means renews the document size/orientation data stored in the memory means, controls the timer to restart its measuring operation, and performs the above operation.

With the above control operation, when the movable copy material feed unit is selected, the copy material orientation changing means is set in a feed position corresponding to a determined orientation of copy material after the lapse of a predetermined time set by the timer. Therefore, the copy material orientation changing means can be set in a desired feed position by one operation thereof even if the document size/orientation data are changed due to a detection error etc. within a predetermined time period. Specifically, a predetermined time period is set before the movement of the copy material orientation changing means and the copy material orientation changing means is not moved until a predetermined time, during which the orientation of a document is determined, lapses. This enables to prevent undesirable movement of the copy material orientation changing means.

The invention and its various advantages will become more apparent to those skilled in the art from the ensuing detailed description of preferred embodiments, reference being made to the accompanying drawings.

BRIEF DESCRIPTION OF THE DRAWINGS

FIGS. 1 to 8 show one embodiment of the present invention.

FIG. 1 is a flow chart showing the control operation of a microcomputer.

FIG. 2 is a view showing the whole structure of a copying machine.

FIG. 3 is a perspective view showing a part of the copying machine shown in FIG. 2, wherein a second rotatable cassette is drawn out.

FIG. 4(*a*) is a partly sectional perspective view of a first rotatable cassette and the second rotatable cassette shown in FIG. 2.

FIG. 4(*b*) is an enlarged perspective view showing a nut shown in FIG. 4(*a*) and the periphery thereof.

FIG. 5 is a perspective view showing the main part of a cassette mounting section which is provided in a main body and a desk, and a projecting member provided in each fixed cassette.

FIG. 6(*a*) is a front view of an operation panel.

FIG. 6(*b*) is a front view of a cassette operation section of the operation panel.

FIG. 7 is a block diagram showing the structure of a control device.

FIG. 8 is a diagram showing the rotating process of the rotating section.

DETAILED DESCRIPTION OF THE EMBODIMENT

With reference to FIGS. 1 to 8, one embodiment of the present invention will be explained below.

Figure 2:
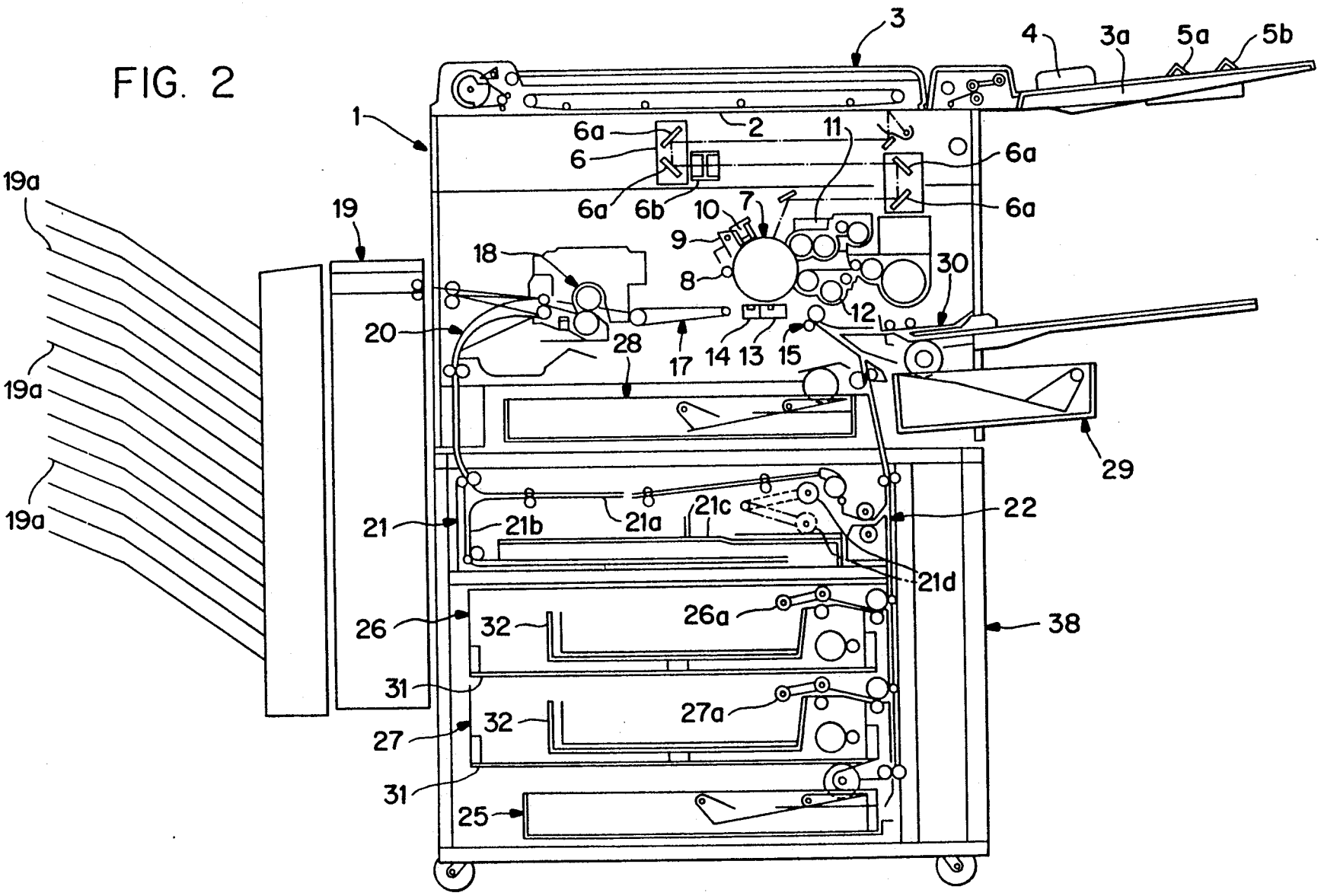
Figure 3:
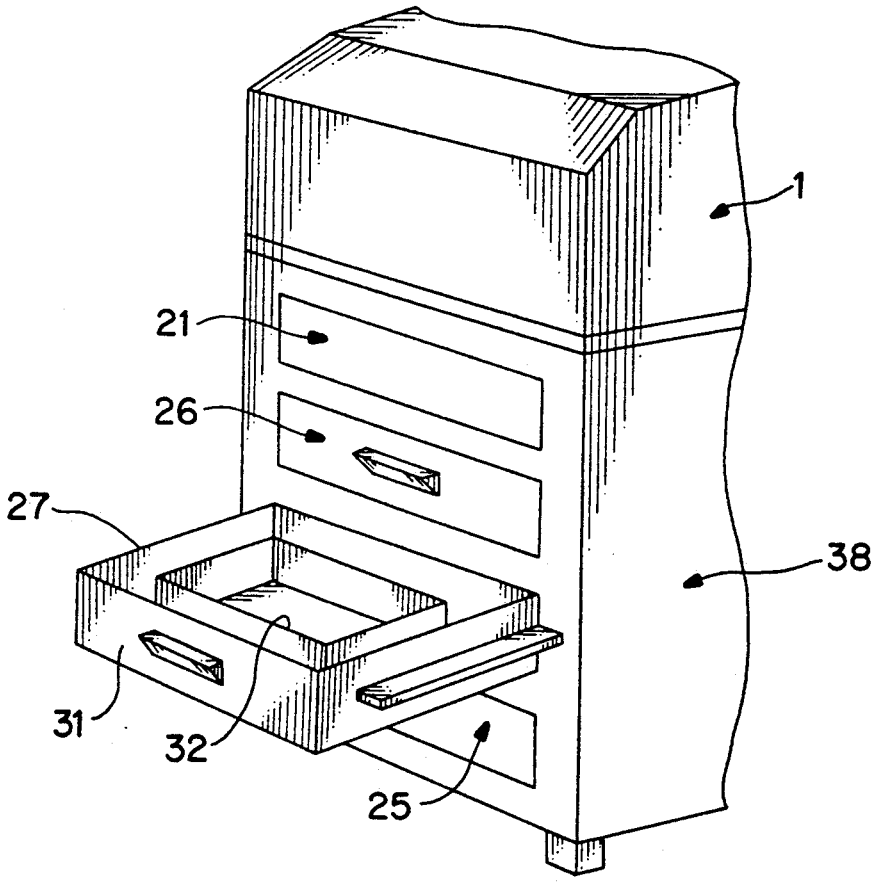

As shown in FIG. 2, a copying machine serving as an image forming apparatus is provided with a desk 38 under a main body 1, a sorter 19 at the paper discharging side of the main body 1 and an automatic document feeder 3 (hereinafter referred to as "ADF") on the main body 1. In a descending scale, the desk 38 is provided with a duplex/composite unit 21, a first rotatable cassette 26 (the movable copy material feed unit), a second rotatable cassette 27 and a third fixed cassette 25 (the fixed copy material feed unit), as shown in FIG. 3. The first and second rotatable cassettes 26 and 27 respectively include a rotating section 32 (the copy material orientation changing means) rotatable within an outer case 31 which serves as a housing member.

The ADF 3 is disposed on the original glass plate 2 of the main body 1. The ADF 3 feeds a document (not shown) from a document tray 3*a* to a specified position on the original glass plate 2 according to the size and orientation of the document (i.e. either of the longitudinal and lateral feed positions), and discharges the document after the completion of the copying operation. In the case of duplex copying, the ADF 3 turns over the document one face of which has been copied, and conveys it to the specified position on the original glass plate 2 again. After the completion of the duplex copying, the ADF 3 discharges the document outside.

On the document tray 3*a* are disposed document length detection switches 5*a* and 5*b* for detecting the size of a document in a feed direction and a guide 4 for guiding a document so as not to be shifted in a direction perpendicular to the feed direction. The guide 4 includes document width detection switch (not shown) for detecting the size of a document in a direction perpendicular to the feed direction. A document size detection device 54 (to be described later) which functions as the document size detection means is made up of the document length detection switches 5*a* and 5*b* and the document width detection switch.

Under the original glass plate 2 is disposed an optical system 6 including a plurality of reflection mirrors 6*a* and a lens 6*b*. The optical system 6 basically guides reflected light from the document onto a photosensitive drum 7, and is designed to perform variable magnification copying operations such as image reduction and image enlargement, in addition to real size copying.

Disposed around the photosensitive drum 7 are a cleaner 8, a static eliminating charger 9, a main charger 10, a developing device 11 having toners for full color copying, and a developing device 12 having toner for black-and-white copying. Disposed under the photosensitive drum 7 are a transferring charger 13 and a separating charger 14. In the conveying direction of the photosensitive drum 7, a conveyor belt 17 and a fixing device 18 are provided.

After a copying operation is completed, paper (i.e. copy material) is basically discharged to copy receiving trays 19*a* through a sorter 19. In the cases of duplex copying and composite copying, paper is guided from a paper returning path 20 to a duplex/composite unit 21. In duplex copying, the paper is guided to a paper feed path 22 after passing through a first delivery path 21*a*, an intermediate tray 21*c*, a delivery roller 21*d* which are disposed within the duplex/composite unit 21. In composite copying, the paper is guided to the paper feed path 22 after passing through a second delivery path 21*b*, the first delivery path 21*a*, the intermediate tray 21*c* and the delivery roller 21*d* within the duplex/composite unit 21. The end of the paper feed path 22 reaches a paper stop roller 15 disposed in the vicinity of the photosensitive drum 7.

The paper feed path 22 is connected to a plurality of paper feed means from which paper is properly fed. More concretely, there are provided, a manual paper feeder 30, a first fixed cassette 29 (the fixed copy material feed unit) capable of storing 500 sheets, a second fixed cassette 28 (the fixed copy material feed unit) capable of storing 250 sheets, the duplex/composite unit 21, the first rotatable cassette 26, the second rotatable cassette 27 and the third fixed cassette 25 capable of storing 250 sheets. The above members are listed in the order of increasing distance to the paper stop roller 15 disposed in the main body 1. The fixed cassettes 29, 28 and 25 and the rotatable cassettes 26 and 27 are all detachable from the copying machine.

Figure 4A:
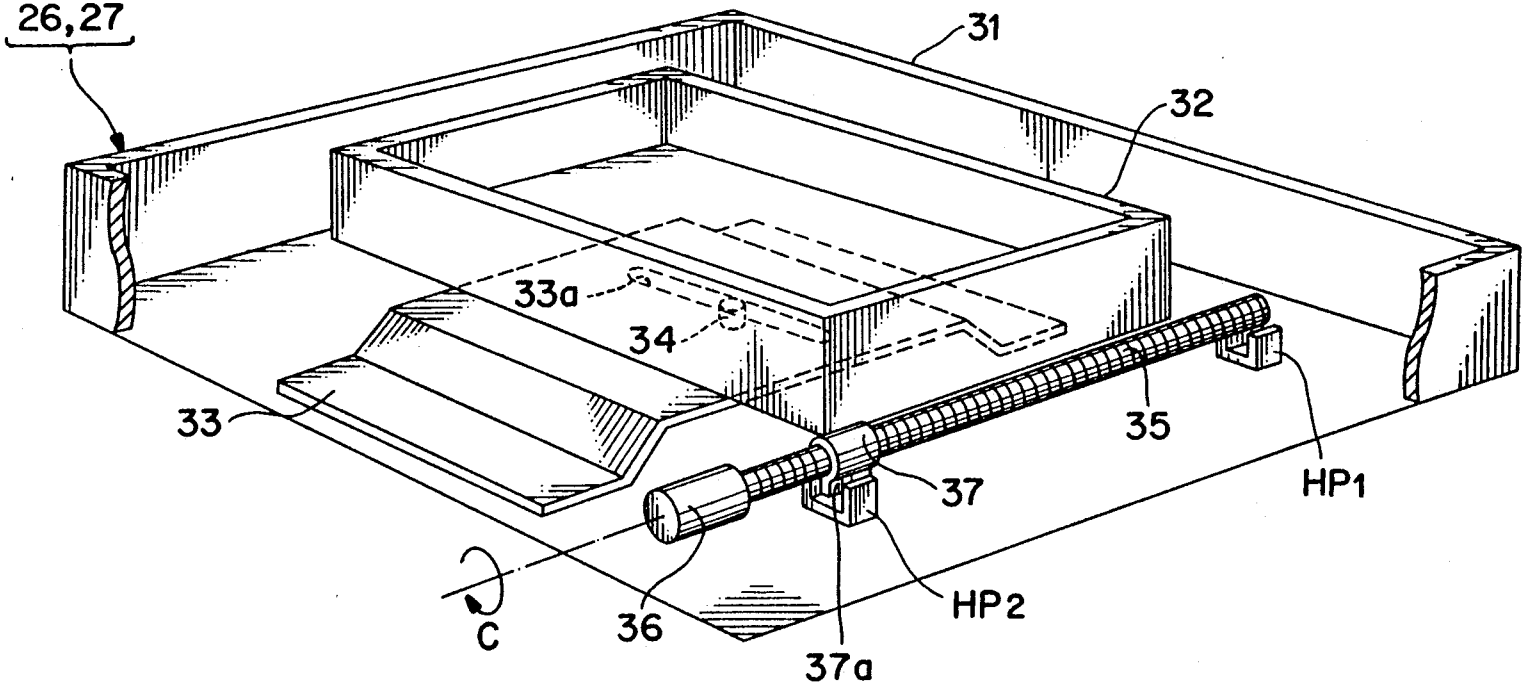
Figure 4B:
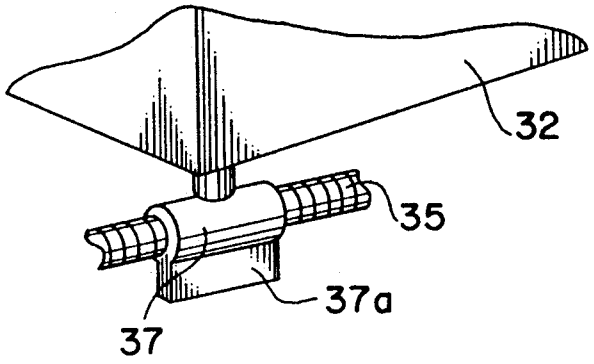

The first and second rotatable cassettes 26 and 27 respectively comprise, as shown in FIG. 4(*a*), the outer case 31 and the rotating section 32 on which paper of a predetermined size is stacked, the rotating section 32 being disposed within the outer case 31. The outer case 31 has, at the bottom wall, a rotating section supporting plate 33 the center portion of which is apart from the bottom wall of the outer case 31. A guide hole 33*a* in the form of an oblong circle is disposed at the center portion of the rotating section supporting plate 33, with its major diameter parallel to a paper feed direction. At the center of the back face of the rotating section 32, there is provided a guide shaft 34 which projects downward so as to pierce the guide hole 33*a*.

The outer case 31 is provided with a threaded shaft 35 positioned parallel to the bottom wall of the outer case 31*a*, which extends in a direction perpendicular to a paper feed direction. The threaded shaft 35 is rotatably supported by a bearing (not shown) and coupled with the rotary shaft of a rotating motor 36 (the driving means) at one end thereof, so as to rotate normally and reversely. The threaded shaft 35 is connected to a nut 37 such that the nut 37 reciprocates along the threaded shaft 35 as the threaded shaft 35 normally or reversely rotates. As shown in FIG. 4(*b*), the upper end of the nut 37 is pivotally connected to one corner of the rotating section 32, and the lower part of the nut 37 is provided with a light interrupting member 37*a*.

There are disposed, at the bottom wall of the outer case 31, a sensor $HP_1$ for detecting that the rotating section 32 is rotated to the lateral feed position and a sensor $HP_2$ for detecting that the rotating section 32 is rotated to the longitudinal feed position. More specifically, the sensor $HP_1$ is positioned under one end of the threaded shaft 35 and the sensor $HP_2$ under the other end thereof. The sensors $HP_1$ and $HP_2$ are photointerrupters each comprising a light emitting element and a light receiving element. When the rotating section 32 moves to a predetermined feed position, (i.e., either of the lateral and longitudinal feed positions), either of the sensors $HP_1$ and $HP_2$ detects that light from the light emitting element to the light receiving element is interrupted by the light interrupting member 37*a*, and the sensor $HP_1$ or $HP_2$ becomes ON, whereby the movement of the rotating section 32 to the predetermined feed position is detected. The sensors $HP_1$ and $HP_2$ are not limited to a photointerrupter, but may be a magnetic sensor, point-contact type switch or other similar devices.

Figure 5:
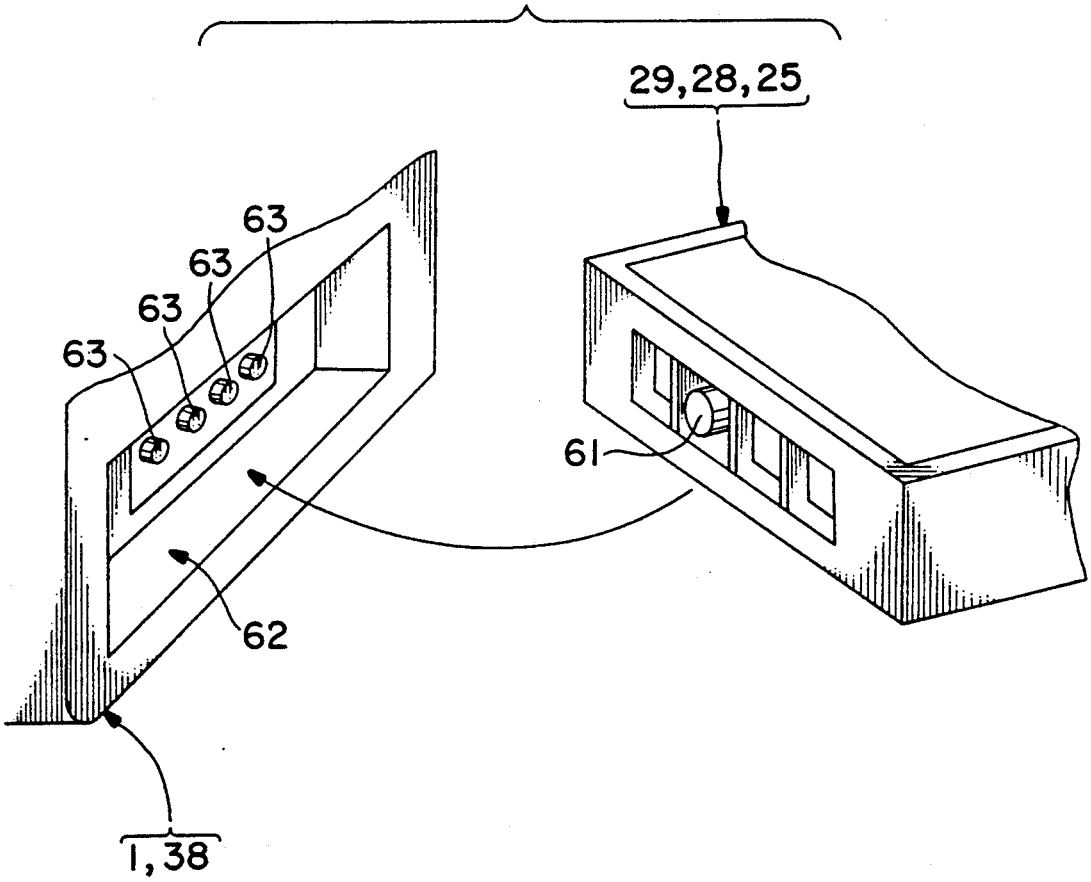

As shown in FIG. 5, the first fixed cassette 29 and the second fixed cassette 28 disposed in the main body 1, and the third fixed cassette 25 disposed in the desk 38 are respectively provided with a projecting member 61. The projecting members 61 are positioned in accordance with the sizes of copy papers to be stored in the fixed cassettes 29, 28 and 25. At cassette mounting sections 62 in the main body 1 and the desk 38, there are provided a plurality of paper size switches 63 which are turned ON by the projecting member 61. For instance, there are four paper size switches 63 corresponding to A3, B4, A4 and B5 sizes respectively. The paper size switches 63 are connected to a microcomputer 51 (to be discussed later). With the above arrangement, the microcomputer 51 identifies the sizes and orientations of papers stored in the fixed cassettes 29, 28 and 25. The sizes of papers stored in the rotating sections 32 in the first and second rotatable cassettes 26 and 27 are input in the microcomputer 51 in the similar manner to the foregoing or by other input means.

Figure 6:
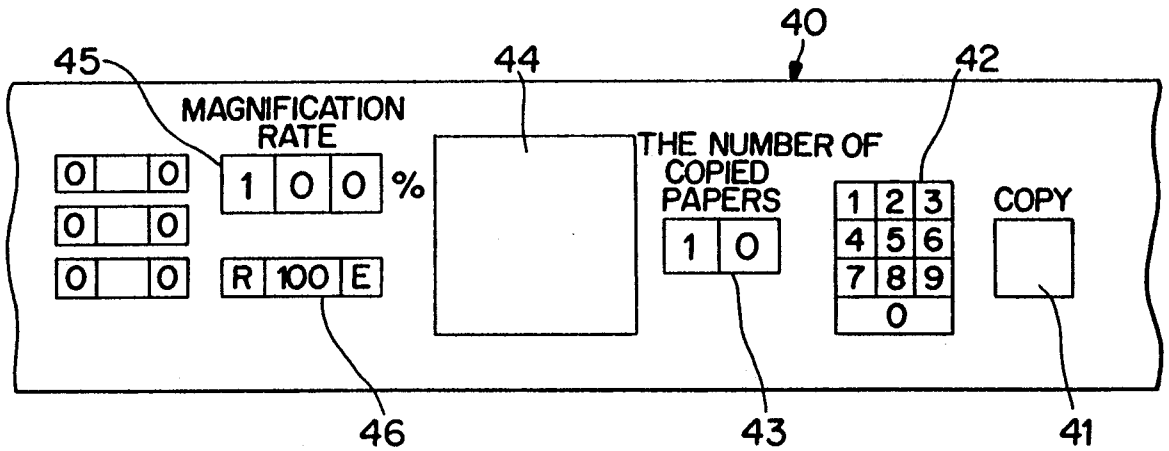
Figure 6:
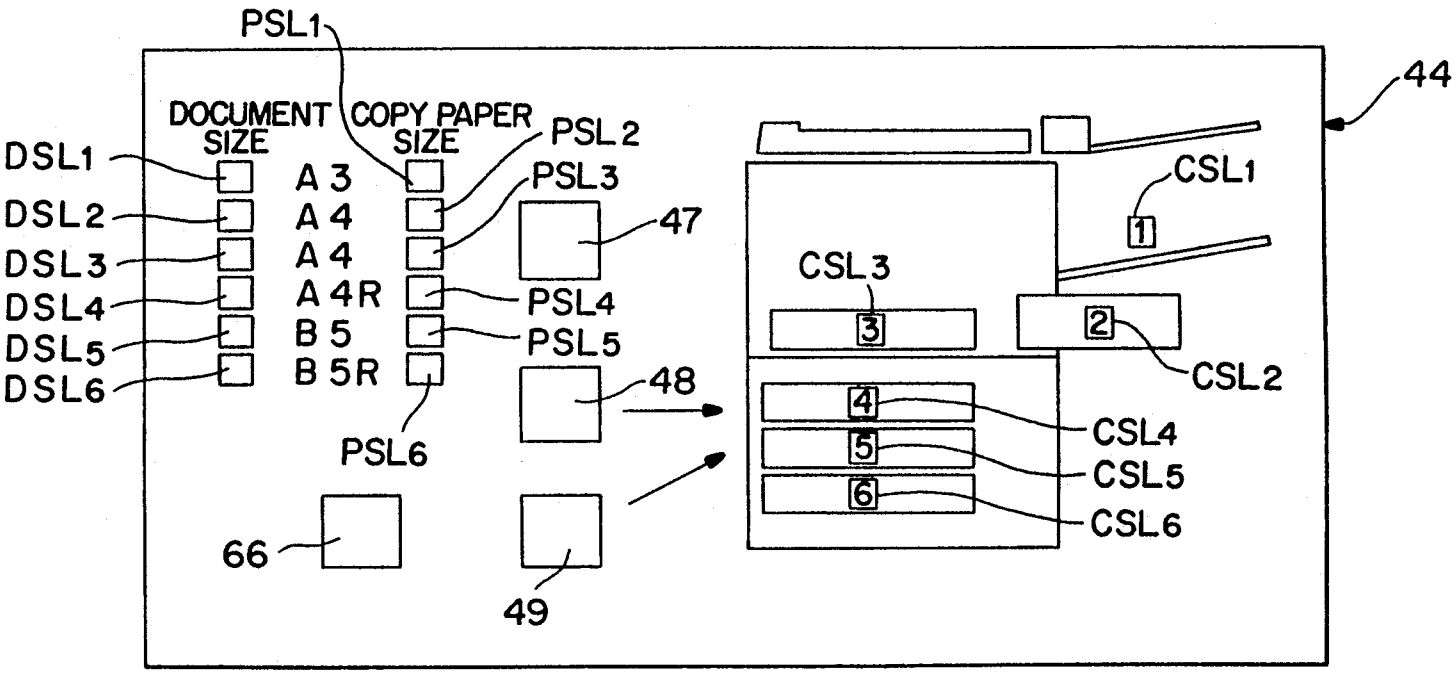

The main body 1 comprises at the upper face thereof an operation panel 40 shown in FIG. 6(*a*). The operation panel 40 comprises a copy button 41 for instructing to start a copying operation, ten keys 42 for setting the number of copies etc., a copy quantity display 43, a cassette operation section 44, a magnification display 45, magnification setting keys 46 and others.

As shown in FIG. 6(*b*), the cassette operation section 44 comprises a cassette changeover key 47 for cassette selection, a rotation key 48 for instructing to rotate the rotating section 32 of the first rotatable cassette 26, a rotation key 49 for instructing to rotate the rotating section 32 of the second rotatable cassette 27, and others. The cassette operation section 44 further comprises document size display lamps $DSL_1$ to $DSL_6$; paper size display lamps $PSL_1$ to $PSL_6$; and cassette selection lamps $CSL_1$ to $CSL_6$ for indicating the manual paper feeder 30, the first fixed cassette 29, the second fixed cassette 28, the first rotatable cassette 26, the second rotatable cassette 27 and the third fixed cassette 25 by the numbers "1" to "6" in this order. The cassette selection lamps $CSL_1$ to $CSL_6$ are selectively lighted in accordance with the selection of the rotatable cassettes 26 and 27, the fixed cassettes 25, 28 and 29, and the manual paper feeder 30 executed by operating the cassette changeover key 47. More concretely, when the first rotatable cassette 26 is selected by operating the cassette changeover key 47 for instance, the cassette selection lamp $CSL_4$ is lighted, and if A4-size paper is stored in the rotating section 32 of the first rotatable cassette 26, the paper size display lamp $PSL_3$ is lighted, thereby indicating that the selected paper is A4-size paper laterally oriented (A4 position). Thereafter, if the rotation key 48 is operated to rotate the rotating section 32 from the lateral feed position to the longitudinal feed position, the paper size display lamp $PSL_4$ is lighted, thereby indicating the selected paper is A4-size paper longitudinally oriented (A4R position). In this case, if there is no paper stored in a selected cassette or manual paper feeder, the paper size display lamps $PSL_1$ to $PSL_6$ are not lighted.

Figure 7:
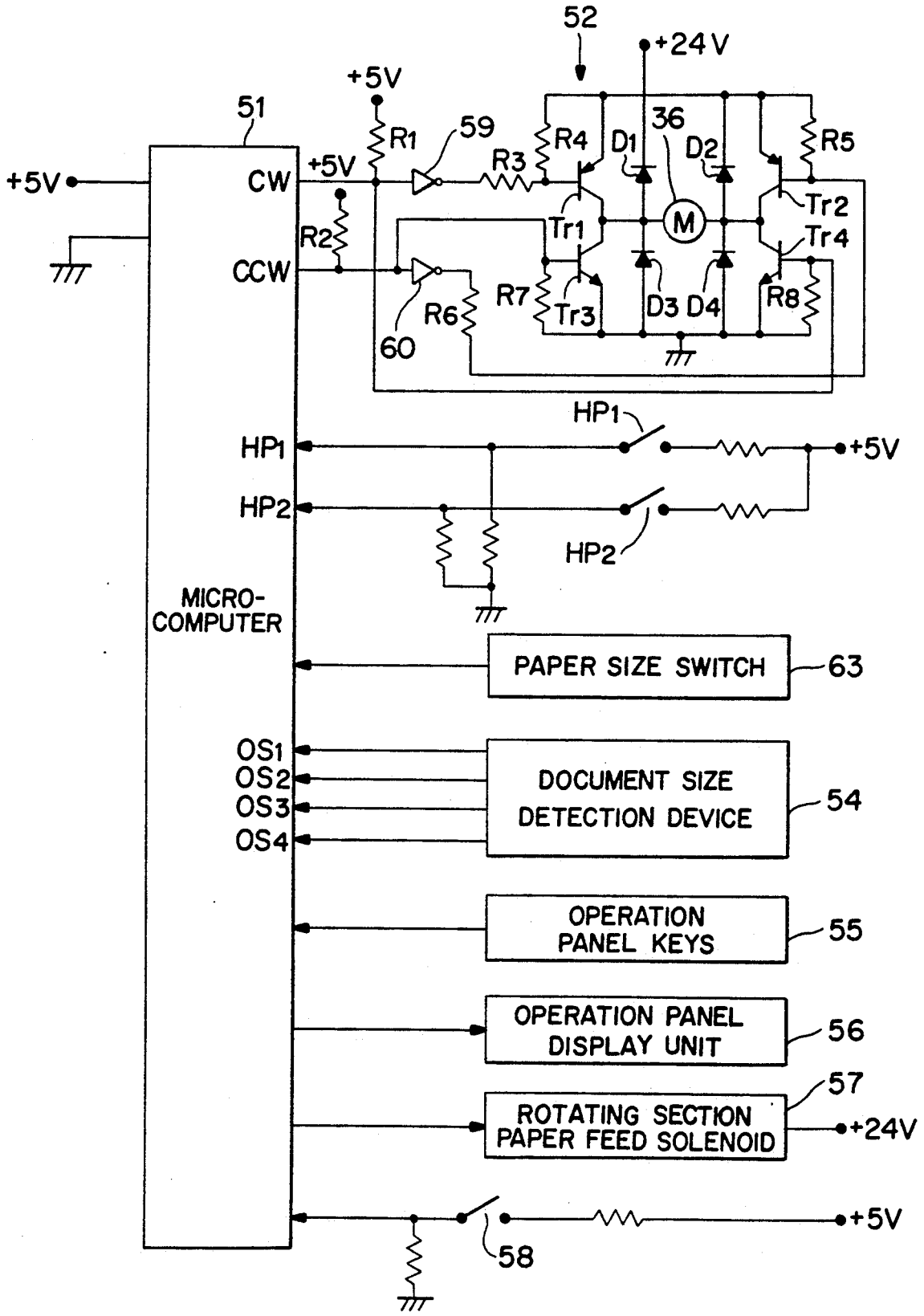

The copying machine is provided as shown in FIG. 7 with the microcomputer 51 which functions as the control means, the memory means (RAM) and a timer. The microcomputer 51 is connected to a motor driver circuit 52, the sensors $HP_1$ and $HP_2$, the paper size switch 63, the document size detection device 54, operation panel keys 55, an operation panel display unit 56, a rotating section paper feed solenoid 57 and a paper entrance detection switch 58.

The motor driver circuit 52 and rotating motor 36, which are shown in FIG. 7, are provided in both first rotatable cassette 26 and second rotatable cassette 27. The motor driver circuit 52 are made up of pull-up resistors $R_1$ and $R_2$, NOT circuits 59 and 60, transistors $Tr_1$ to $Tr_4$, resistors $R_3$ to $R_8$ and diodes $D_1$ to $D_4$ functioning as surge absorbers, and drives the rotating motor 36 so as to rotate normally and reversely in accordance with the output of the microcomputer 51. The pull-up resistor $R_1$, the input of the NOT circuit 59 and the base of the transistor $Tr_4$ are respectively connected to the output terminal CW of the microcomputer 51. The output of the NOT circuit 59 is connected to the base of the transistor $Tr_1$ via the resistor $R_3$. The base of the transistor $Tr_1$ is connected to one end of the resistor $R_4$ and the base of the transistor $Tr_2$ is connected to one end of the resistor $R_5$. The other ends of the resistors $R_4$ and $R_5$, the emitters of the transistors $Tr_1$ and $Tr_2$, and the cathodes of the diodes $D_1$ and $D_2$ are all connected to the plus terminal of the power supply, and voltage (+24 V) is applied to the terminal. The collector of the transistor $Tr_1$ and the anode of the diode $D_1$ are connected to one input terminal of the rotating motor 36, and the collector of the transistor $Tr_2$ and the anode of the diode $D_2$ are connected to the other input terminal of the rotating motor 36. The pull-up resistor $R_2$, the input of the NOT circuit 60 and the base of the transistor $Tr_3$ are connected to the output terminal CCW of the microcomputer 51 and the output of the NOT circuit 60 is connected to the base of the transistor $Tr_2$ via the resistor $R_6$. The base of the transistor $Tr_3$ is connected to one end of the resistor $R_7$ and the base of the transistor $Tr_4$ is connected to one end of the resistor $R_8$. The other ends of the resistors $R_7$ and $R_8$, the emitters of the transistors $Tr_3$ and $Tr_4$, and the anodes of the diodes $D_3$ and $D_4$ are all connected to the minus terminal of the power supply and this terminal is connected to ground. The collector of the transistor $Tr_3$ and the cathode of the diode $D_3$ are connected to one input terminal of the rotating motor 36 and the collector of the transistor $Tr_4$ and the cathode of the diode $D_4$ are connected to the other input terminal of the rotating motor 36.

The motor driver circuit 52 is designed such that the rotating section 32 of the first rotatable cassette 26 and the rotating section 32 of the second rotatable cassette 27 are rotated to the lateral feed position (e.g. A4 or B5 position) when the output terminal CCW of the microcomputer 51 is at a high level (with the output terminal CW being at a low level), and to the longitudinal feed position (e.g. A4R or B5R position) when the output terminal CW is at a high level.

The document size detection device 54 supplies 4 bits data to input terminals $OS_1$ to $OS_4$ of the microcomputer 51.

The operation keys 55 include the copy button 41, the ten keys 42, the magnification setting keys 46, the cassette changeover key 47, the cassette rotation keys 48 and 49 and others (the buttons and keys are all provided on the operation panel 40 of the main body 1).

The operation panel display unit 56 includes the copy quantity display 43, the magnification display 45, the document size display lamps $DSL_1$ to $DSL_6$, the paper size display lamps $PSL_1$ to $PSL_6$, the cassette selection lamps $CSL_1$ to $CSL_6$ and others (the displays and lamps are all provided on the operation panel 40 shown in FIGS. 6(*a*) and 6(*b*)).

The rotating section paper feed solenoid 57 is for actuating a pick-up roller 26*a* of the first rotatable cassette 26 and a pick-up roller 27*a* of the second rotatable cassette 27 so as to pick up a copy paper.

The paper entrance detection cassette 58 is disposed just in front of the paper stop roller 15 shown in FIG. 2, for detecting that a copy paper reaches the paper stop roller 15.

When one of the operation panel keys 55 is depressed, the microcomputer 51 starts its control operation according to the key depressed. For example, when the rotation key 48 for the first rotatable cassette 26 is depressed in order to instruct to rotate the rotating section 32 of the first rotatable cassette 26 from the lateral feed position to the longitudinal feed position, the level of the output terminal CW becomes high and the level of the output terminal CCW becomes low. On the other hand, if the key operation is executed for instructing to rotate the rotating section 32 from the longitudinal feed position to the lateral feed position, the level of the output terminal CCW becomes high and the level of the output terminal CW becomes low. When the rotating section 32 is rotated to the lateral feed position and the sensor $HP_1$ is turned ON (i.e. the light running in the photointerrupter is interrupted), the level of the output terminal CCW immediately becomes low, thereby halting the rotating motor 36. On the contrary, when the rotating section 32 is rotated to the longitudinal feed position and the sensor $HP_2$ is turned ON, the level of the output terminal CW immediately becomes low, thereby halting the rotating motor 36.

The microcomputer 51 has functions of identifying the size/orientation of a document based on 4 bits data released from the document size detection device 54; turning on the corresponding lamp selected from the document size display lamps $DSL_1$ to $DSL_6$; and automatically selecting a cassette that stores copy paper corresponding to the detected document size and determined orientation of the copy paper, based on the inputs of the document size detection device 54 and the magnification setting key 46 (automatic copy material selection function). The microcomputer 51 further performs another control operation as shown in FIG. 1 which is described later.

Taking the first rotatable cassette 26 for example, the rotating section 32 in the above arrangement will be described.

Figure 8:
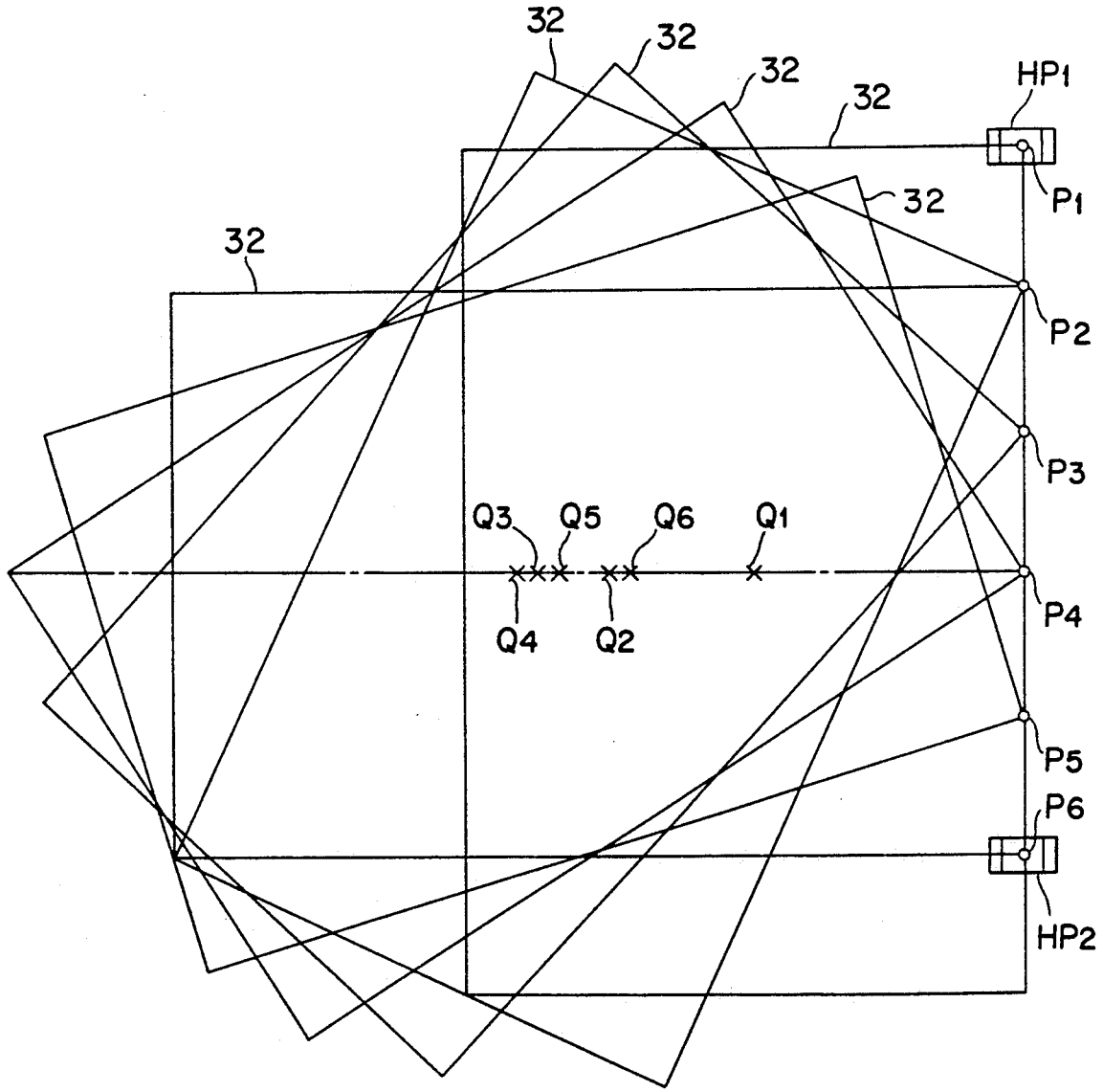

Suppose that A4-size paper is stored in the rotating section 32 of the first rotatable cassette 26 and the rotating section 32 is positioned in the lateral feed position (i.e. A4 position). The sensor $HP_1$ is turned ON and the lamps on the operation panel display unit 56 indicate the first rotatable cassette 26 and "A4R". At that time, the nut 37 disposed at the threaded shaft 35 is located at the position $P_1$ as shown in FIG. 8.

When the rotation key 48 for the first rotatable cassette 26 is operated, the output terminal CW of the microcomputer 51 becomes high and the output terminal CCW thereof becomes low. This causes the transistor $Tr_1$ and the transistor $Tr_4$ to be turned ON and current to flow through the (+24 V) power source, the transistor $Tr_1$, the rotating motor 36, the transistor $Tr_4$ and ground in this order, thereby normally rotating the rotating motor 36. With the rotation of the cassette rotating motor 36, the threaded shaft 35 is rotated in the direction indicated by the arrow C in FIG. 4(*a*). Then, the nut 37 moves from the position $P_1$ to the position $P_6$ and the guide shaft 34 of the rotating section 32 is rotatively slid within the guide hole 33*a* of the rotating section supporting plate 33 so as to reciprocate between the positions $Q_1$ and $Q_6$ via the positions $Q_2$, $Q_3$, $Q_4$ and $Q_5$.

Thereafter, the nut 37 reaches the sensor $HP_2$ to turn the sensor $HP_2$ ON, thereby halting the rotating motor 36. At this stage, the rotating section 32 is set in the predetermined longitudinal feed position (A4R position).

If the rotation key 48 is operated again in this stage, the output terminal CCW of the microcomputer 51 becomes high and the output terminal CW thereof becomes low. This causes the transistors $Tr_2$ and $Tr_3$ to be turned ON and current to flow through the (+24 V) power source, the transistor $Tr_2$, the rotating motor 36, the transistor $Tr_3$ and ground in this order, thereby reversely rotating the rotating motor 36. This rotation permits the rotating section 32 to rotate from the longitudinal feed position to the lateral feed position in the opposite process to the foregoing. When the sensor $HP_1$ is turned ON thereafter, the rotating motor 36 is halted and the rotating section 32 is set in the predetermined lateral feed position.

Referring now to the flow chart of FIG. 1, the control operation of the microcomputer 51 for the rotating section 32 of the first rotatable cassette 26' or the second rotatable cassette 27 will be explained below.

The microcomputer 51 firstly judges whether or not document size/orientation data are released from the document size detection device 54 after a document is placed on the document tray 3*a* of the ADF 3 as shown in FIG. 2 (Step 1) (a step is hereinafter referred to "S"), and if so, stores the data in the RAM as OSDATA (S2). At the same time, the microcomputer 51 starts the measuring operation of the timer (S3). Thereafter, the microcomputer 51 judges whether another item of document size/orientation data is input within a predetermined period of time set by the timer (S4), and if so, judges whether the new item of document size/orientation data is equal to the OSDATA stored in the RAM (S5). If the new item of document size/orientation data is not equal to the OSDATA, the program returns to S2 in order for the microcomputer 51 to store the new document size/orientation data in the RAM as OSDATA, replacing the previous OSDATA and start the measuring operation of the timer again.

If it is judged in S5 that the new document size/orientation data are equal to the OSDATA stored in the RAM, or it is judged in S4 that there are not newly input document size/orientation data, after the predetermined period of time is measured by the timer (S6), the microcomputer 51 resets the timer (S7). Then, the microcomputer 51 selects a cassette that stores appropriate copy paper for copying the document (the automatic paper selection function) and determines a paper orientation, in accordance with the document size/orientation data (OSDATA) and copy magnification data input by the magnification setting key 46 disposed on the operation panel 40 (S8). Suppose that the first rotatable cassette 26 is selected for feeding paper in this stage and A4-size paper is stored in the rotating section 32 thereof. If it is judged that the orientation of the selected paper is "lateral" (S9), the output terminal CCW becomes high (S10) and the output terminal CW becomes low (S11). This causes the rotating motor 36 to rotate the rotating section 32 to the lateral feed position. Thereafter, the microcomputer 51 judges whether the sensor $HP_1$ is turned ON (S12), and if so, permits the output terminal CCW to be low (S13). This causes the rotating motor 36 to be halted and the rotating section 32 to be in the lateral feed position (in this case, A4 position).

On the other hand, if it is judged in S9 that the orientation of the selected paper is "longitudinal", the output terminal CCW becomes low (S14), the output terminal CW becomes high (S15) and the rotating section 32 is rotated to the longitudinal feed position. Then, the microcomputer 51 judges whether or not the sensor $HP_2$ is turned ON (S16), and if so, causes the output terminal CW to be low (S17). This allows the rotating section 32 to be in the longitudinal feed position (in this case, A4R position).

In the above arrangement, if the first rotatable cassette 26 for example is selected for paper feeding, the rotating section 32 disposed within the first rotatable cassette 26 is not immediately rotated to a feed position corresponding to the orientation of selected paper, but rotated thereto after a predetermined period of time set by the timer has elapsed. That is, the feed position in which the rotating section 32 is set is deemed to be determined within this time period. Therefore, even if the document size/orientation data has been changed due to a detection error etc., the rotating section 32 can be set in a desired feed position by rotating it once.

As described above, the image forming apparatus of the invention comprises (1) a rotating section of a rotatable cassette, which is rotated by a rotating motor, between the lateral feed position from which copy paper laterally oriented with respect to a paper feed direction is fed and the longitudinal oriented with respect to the paper feed direction is fed; (2) document size detection means for detecting the size/orientation of a document; (3) an automatic paper selection function for selecting a cassette which stores appropriate copy paper to be fed, based on document size/orientation data obtained from the document size detection means and magnification data; (4) a timer for measuring a predetermined time period; (5) memory means for storing the document size/orientation data; and (6) control means for (i) controlling the timer to start its measuring operation upon detection of a document size/orientation by the document size detection means, (ii) controlling the rotating motor to rotate the rotating section to either of the longitudinal feed position and lateral feed position which corresponds to a selected paper orientation if the rotatable cassette provided with the rotating section is selected for paper feeding by the automatic paper selection function, and there occurs no change in the document size/orientation data sent from the document size detection means to the memory means until the completion of the measuring operation by the timer, and (iii) renewing the document size/orientation data stored in the memory means and restarting the measuring operation of the timer if there occurs a change in the document size/orientation data until the completion of the first set measuring operation of the timer. With such an arrangement, even if the document size/orientation data has been changed due to a detection error etc. before the elapse of a predetermined time period set by the timer, the rotating section of the rotatable cassette will be in a desired feed position without undesirable rotations. This enables to reduce noise caused when the rotating section of the rotatable cassette is rotated by the rotating motor, thereby preserving the office environment.

The invention being thus described, it may be obvious that the same may be varied in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. An image forming apparatus comprising:

copy material orientation changing means for setting copy material at at least two positions, the means being provided in a movable copy material feed unit and driven by driving means;

document size detection means for detecting the size and orientation of a document;

an automatic copy material selection function for selecting a fixed copy material feed unit or movable copy material feed unit which stores appropriate copy material to be fed, in accordance with magnification data and document size/orientation obtained from the document size detection means;

a timer for measuring a predetermined period of time;

memory means for storing the document size/orientation data; and control means for (i) controlling the timer to start its measuring operation upon detection of a document size/orientation by the document size detection means, (ii) controlling the driving means to shift the copy material orientation changing means to a position corresponding to a determined orientation of the copy material if the movable copy material feed unit is selected for the use of feeding paper by the automatic copy material selection function and the document size/orientation data sent from the document size detection means to the memory means has not been changed before the completion of the measuring operation by the timer, and (iii) renewing the document size/orientation data stored in the memory means and restarting the measuring operation of the timer if there occurs a change in the document size/orientation data before the completion of the first set measuring operation of the timer.

2. The image forming apparatus according to claim 1, comprising a microcomputer wherein the timer, the control means and a RAM which functions as the memory means may be included.

3. The image forming apparatus according to claim 2, wherein the driving means may be a motor rotatable normally and reversely.

4. The image forming apparatus according to claim 3, wherein the motor is connected to a motor driver circuit connected to the microcomputer, the motor driver circuit comprising resistors, NOT circuits, transistors, diodes operatively connected, and driving the motor in accordance with the output from the microcomputer.

5. The image forming apparatus according to claim 3, wherein one end of the motor is coupled with a threaded shaft to which a nut is connected so as to reciprocate in the axial direction in accordance with the rotation of the threaded shaft.

6. The image forming apparatus according to claim 5, wherein the upper end of the nut is rotatively connected to a corner of the copy material orientation changing means, and the lower end thereof is provided with a light interrupting member.

7. The image forming apparatus according to claim 6, further comprising position detection means for detecting the position of the copy material orientation changing means.

8. The image forming apparatus according to claim 7, wherein the position detection means may be a photointerrupter having a light emitting element and a light receiving element, which is connected to the microcomputer and turned ON when light is interrupted by the light interrupting member.

9. The image forming apparatus according to claim 7, wherein the position detection means may be a magentic sensor or point-contact type switch.

10. The image forming apparatus according to claim 2, wherein the document size detection means comprises a document length detection switch for detecting the size of a document in a feeding direction and a document width detection switch for detecting the size of a document in a direction perpendicular to the feed direction, and may be a document size detection device connected to the microcomputer.

11. The image forming apparatus according to claim 2, wherein the fixed copy material feed unit includes a projecting member positioned in accordance with the size of copy material to be stored therein, and when the fixed copy material feed unit is mounted in the main body of the apparatus, a copy material size switch connected to the microcomputer provided in the main body is turned ON by the projecting member, so that the size of the stored copy material is identified.

12. The image forming apparatus according to claim 1, wherein the copy material orientation changing means is a rotating section substantially 90° rotatable about a guide member formed at the center of the reverse side thereof, and is housed in a housing member which can be mounted in the main body of the apparatus and removed therefrom.

13. The image forming apparatus according to claim 12, wherein the rotating section is rotatable between a longitudinal feed position from which copy material longitudinally oriented with respect to a feed direction is fed and lateral feed position from which copy material laterally oriented with respect to the feed direction is fed.

14. The image forming apparatus according to claim 12, wherein the housing member includes a supporting member for keeping a space between the copy material orientation changing means and the bottom wall of the housing member.

15. The image forming apparatus according to claim 14, wherein the supporting member includes an elongate-circle-shaped guide hole disposed at the center thereof, in such a way that the guide member rotatively reciprocates within the guide hole.

16. The image forming apparatus according to claim 1, wherein the copy material is paper used for a copying machine or laser printer.

17. The image forming apparatus according to claim 1, wherein the copy material is a film used for an overhead projector.

18. A method for controlling copy material orientation changing means of an image forming apparatus comprising:

a first step of storing document size/orientation data released from the document size detection means in memory means as OSDATA;

a second step of starting the measuring operation of a timer;

a third step of judging whether or not another item of document size/orientation data is entered within a predetermined period of time set by the timer;

a forth step of judging whether or not the new item of data is the same as the OSDATA stored in the memory means, if another item of document size/orientation data is entered;

a fifth step of storing the new item of data in the memory means and restarting the measuring operation of the timer, if the new item of document size/orientation data is not the same as the OSDATA;

a sixth step of resetting the timer, selecting a copy material feed unit which stores appropriate copy material to be fed and determining the orientation of the copy material with respect to a feed direction, after completion of the measuring operation by the timer, if no new item of document size/orientation data is entered; and a seventh step of shifting the copy material orientation changing means disposed in the selected movable copy material feed unit to a position corresponding to the determined orientation of the copy material.

19. The control method according to claim 18, wherein the seventh step comprises the steps of:

judging whether or not the determined orientation of the copy material is lateral; and moving the copy material orientation changing means until a sensor for detecting that the copy material orientation changing means is laterally oriented is turned ON if the determined orientation is lateral, and moving the copy material orientation changing means until a sensor for detecting that the copy material orientation changing means is longitudinally oriented is turned ON if the determined orientation is longitudinal.

* * * * *